US006277214B1

(12) United States Patent
Akhtar et al.

(10) Patent No.: US 6,277,214 B1
(45) Date of Patent: Aug. 21, 2001

(54) PROTECTIVE IRON OXIDE SCALE ON HEAT-TREATED IRONS AND STEELS

(75) Inventors: Ainul Akhtar; Gity Samadi, both of Vancouver (CA)

(73) Assignee: Powertech Labs Inc., Surrey (CA)

( * ) Notice: Subject to any disclaimer, the term of this patent is extended or adjusted under 35 U.S.C. 154(b) by 0 days.

(21) Appl. No.: 09/350,568

(22) Filed: Jul. 9, 1999

(51) Int. Cl.[7] ..... C23C 8/10

(52) U.S. Cl. ..... 148/287; 148/287; 148/662; 148/663

(58) Field of Search ..... 148/276, 277, 148/287, 660, 662, 663; 428/472.2

(56) References Cited

U.S. PATENT DOCUMENTS

| | | | | |
|---|---|---|---|---|
| 1,467,174 | | 9/1923 | Kern . | |
| 3,421,307 | | 1/1969 | Lunsford . | |
| 3,479,232 | * | 11/1969 | Broussard | 148/336 |
| 3,549,425 | * | 12/1970 | Segura et al. | 148/341 |
| 3,720,544 | * | 3/1973 | Entringer | 148/595 |
| 4,035,200 | | 7/1977 | Valentijn . | |
| 4,714,497 | | 12/1987 | Poncet . | |
| 5,496,646 | * | 3/1996 | Bacigalupo | 428/472.2 |

FOREIGN PATENT DOCUMENTS

| | | |
|---|---|---|
| 19736514 | 9/1998 | (DE) . |
| 61-232536 | 10/1986 | (JP) . |
| WO 99/10556 | 3/1999 | (WO) . |

OTHER PUBLICATIONS

Volrabova et al., "Surface treatment of sintered steels by ocidation in superheated steam," *Chemical Abstracts*, vol. 94, No. 2, Abstract No. 6448, 1981, (No month data).

Tomlinson et al., "Substrate roughness, cold work and the oxidation of pure iron at 200–600°C ," *Journal of Material Science Letters*, 9(9): 1005–1010, Sep. 1990.

Cooper et al., "Fatigue Microcrack Initiation in Polycrystalline Alpha–Iron with Polished and Oxidized Surfaces," *Metallurgical Transactions*, 16A:641–649, 1985. (No month data).

* cited by examiner

*Primary Examiner*—John Sheehan
*Assistant Examiner*—Andrew L. Oltmans
(74) *Attorney, Agent, or Firm*—Brown Martin Haller & McClain LLP

(57) ABSTRACT

The invention provides a process for the heat treatment of iron-based alloys, including irons and steels, such as carbon steels and low alloy steels, in a controlled oxidative environment, to modify the microstructure of the metal to obtain both improved mechanical properties and a protective surface oxide scale. In a first high-temperature treatment, a layer of wüstite (FeO) is formed on the surface of the material and austenite forms in the interior of the material. Rapid cooling follows the high temperature treatment so as to preserve the wüstite scale and to obtain at the same time an internal steel microstructure comprising martensite or bainite. In a second step of lower-temperature heat treatment, the scale is transformed so that it comprises an intermediate layer composed predominantly of wüstite (FeO), with a surface of predominantly magnetite ($Fe_3O_4$), while the mechanical properties of the material are tailored for specific applications.

20 Claims, 11 Drawing Sheets

(a)

(b)

(a) (b)

PROTECTIVE IRON OXIDE SCALE ON HEAT-TREATED IRONS AND STEELS

FIELD OF THE INVENTION

The invention relates to processes for treating iron-based alloys including irons and steels, and objects made therefrom, to produce desired mechanical properties and to provide selected iron-oxide-containing surfaces, and useful products such as natural gas cylinders having the desired mechanical properties and the protective oxide surfaces.

BACKGROUND OF THE INVENTION

The mechanical and chemical properties of iron-containing metals, alloys and steels depend upon the internal and external crystalline structure of the material, which may be altered by heat treatments such as annealing, normalizing, quenching and tempering. Heat treatments, particularly quenching and tempering, are commonly used to manipulate the internal microstructure of steel to obtain improved mechanical properties from a given steel composition. Quenching involves heating the steel above a critical temperature that is sufficiently high to form austenite (which differs depending upon the elemental composition of the steel), and then hardening the steel by quenching, in a medium such as oil, water, other liquids or blasts of a gas such as air, to cool the steel rapidly and thereby induce the formation of martensite or bainite, to provide a hard microstructure. The microstructure of heat-treated hardened steels gives the material a high strength but a low ductility. To increase the fracture toughness of the material, the as-quenched steel may be subjected to a second heat treatment called tempering. In tempering, the material is reheated to a temperature below the critical temperature for quenching, and maintained at the tempering temperature for a period of time to obtain the desired characteristics of strength and ductility. Some steels may not be amenable to these transformations of microstructure, and are not hardenable with heat treatment, such as very-low-carbon-containing and other ferritic and austenitic steels for which the critical quenching temperature for formation of austenite is below room temperature. The nature of steels that are hardenable with heat treatment is well known in the art, and the susceptibility of materials to hardening with heat treatment is readily determined empirically. In one aspect, the present invention relates to the treatment of any iron-based alloys including irons and steels that provide desired mechanical properties when quenched and tempered.

During heat treatment various oxides of iron may be formed on the surface of iron or steel, depending upon the temperature, length of heating, rate of cooling, and availability of oxygen during these various phases of potential oxide formation. In order of oxidation state of the iron, these oxides are ferrous oxide (FeO), called wüstite or wuestite, magnetite ($Fe_3O_4$) and ferric oxide, called hematite ($Fe_2O_3$). The arrangement of these oxides on a surface may be complex, and may change with heat treatment, just as the internal microstructure varies with different heat treatments. The formation of the oxides may initially be determined by surface reaction conditions. Thicker oxide layers may evolve under heating through a process of oxygen diffusion within the oxide lattice. The structure of the oxide layers will affect the rate and extent of any such diffusion, and may be significantly affected by the presence of alloying elements such as chromium, aluminum or silicon. At high temperatures, for example above approximately 560° C. for some steels, wüstite will typically predominate in an oxide scale. At lower temperatures, wüstite may decompose into iron or magnetite, and magnetite may be transformed into hematite.

In many circumstances, an external iron oxide layer (scale) is an undesirable byproduct of heat-treating steels or irons in an oxidizing environment, particularly the penetrating oxidation of plain-carbon or low-alloy steels. In some applications, however, a protective iron oxide coating may be desirable. For example, U.S. Pat. No. 4,035,200 issued to Valentijn on Jul. 12, 1977, discloses an innovation in the field of 'blackening' processes that are used to produce a protective, dark oxide layer consisting predominantly of $Fe_3O_4$ (magnetite) on an iron surface in a single step treatment in the range of 500° C.–650° C. The innovation disclosed therein apparently relates to the use of a particular oxidizing atmosphere comprised of combustion gasses flowing over the workpiece. Another process for obtaining a relatively homogeneous oxide layer, in this case FeO (wüstite) is disclosed in International Patent Publication WO 99/10556, dated Mar. 4, 1999. U.S. Pat. No. 3,940,294, issued to Sergeant, Feb. 24, 1976, suggests that wüstite may be a preferred oxide scale because it is relatively easy to remove, and that patent discloses a method of suppressing the transformation of a wüstite scale to magnetite which may otherwise occur in making hot rolled steel stock. Academically, it has been suggested, however, that a thin, homogeneous wüstite scale may be relatively resistant to fatigue microcrack propagation (C. V. Cooper and M. E. Fine, "Fatigue Microcrack Initiation in Polycrystalline Alpha-Iron with Polished and Oxidized Surfaces", Metallurgical Transactions A, vol. 16A, pp 641–649, 1985). Cooper & Fine disclose a process that produced 0.1–0.35 $\mu$m thick FeO on polycrystalline pure iron using a controlled ratio of $CO:CO_2$ flowing over the steel specimens kept at a temperature of 627° C. This oxide layer was used to investigate the role of wüstite (FeO) in the initiation of fatigue cracks in iron. An decrease in the fatigue life was noted as a result of the wüstite layer.

Although the methods and products of the present invention are not limited to any particular practical application, one area of potential application is in the field of steel vessels for pressurized gases. For example, the natural gas vehicle (NGV) industry makes use of pressure vessels (cylinders) for the on-board storage of compressed natural gas (CNG) fuel. Steel cylinders are also used for the ground storage of CNG at fuelling stations. The interior surface of those steel cylinders and liners may be exposed to contaminants present in the natural gas, such as moisture ($H_2O$), carbon dioxide ($CO_2$) and hydrogen sulphide ($H_2S$). Moreover, dynamic stresses are generated on the cylinder wall due to the pressure cycling of the vessel. Fuelling generates a high pressure, whereas, fuel consumption drops the pressure to a low value. This combination of the dynamic stresses and the corrosive contaminants causes corrosion fatigue to occur in NGV service, thus limiting the life of the steel cylinders and the steel-liners. For a given wall thickness, it may be possible to extend the life of the cylinder if the interior of the cylinder is protected from corrosion fatigue. Alternatively, a protective coating may facilitate the use of cylinders having thinner walls, permitting the use of less massive vessels to enhance vehicle fuel efficiency. Applying conventional protective coatings on the interior of a cylinder may, however, be somewhat difficult and costly.

Low alloy steels are generally used for the fabrication of NGV cylinders. A modified form of AISI/SAE 4130 (American Iron & Steel Institute/Society of Automotive Engineers) steel is often employed. Although the composition of the low alloy steel may vary, the composition shown in Table 1 is typical.

TABLE 1

| Element | Weight % |
|---|---|
| C | 0.35 |
| Cr | 0.80 |
| Ni | 0.30 |
| Mo | 0.15 |
| Mn | 0.50 |
| Si | 0.35 |
| S | 0.02 |

The fabrication process used for obtaining the desired shape of the vessel may vary. However, the shaping of the vessel is generally completed before the vessel is subjected to heat treatment. Prior to heat treatment, the shaped cylinder usually has a single narrow opening which is threaded for making the appropriate pressure connection in service. Alternatively, two narrow threaded openings may be provided, one located at each end of the cylinder.

Shaped steel pressure vessels are generally quenched by being heated to an austenitizing temperature, typically around 860° C. for about 1–2 hours, and then rapidly cooled through immersion of the hot vessel into a liquid bath or a liquid spray. The quenching liquid may be water or an appropriate mixture of other chemicals. This process of quenching produces a hard microstructure (either martensite or bainite). This hard microstructure gives the cylinder material a high strength but a low ductility. In order to increase the fracture toughness of the material (to enhance safety of the pressure vessel in service) the as-quenched cylinder is subjected to a tempering treatment. In tempering, the cylinder is heated to a predetermined fixed temperature that is lower than the austenitizing temperature, which may lie between 500° C.–650° C. At this temperature the vessel may be maintained for 1–2 hours, before being cooled down to room temperature. The choice of a specific combination of the tempering temperature and time may be dictated by the hardness (strength) and ductility (or toughness) requirements for the final product. Normally, the cylinder interior remains untouched following the fabrication heat treatment. However, the exterior surface of the cylinder is cleaned (sand or grit blasting is commonly employed) and a coating is applied to the cylinder exterior in order to prevent atmospheric corrosion. There is however a need for processes that may be used to provide a protective coating on the interior of such cylinders.

SUMMARY OF THE INVENTION

In one aspect, the invention provides a process for the heat treatment of iron-based alloys including irons and steels, such as carbon steels and low alloy steels, in a controlled oxidative environment, to modify the microstructure of the metal to obtain both improved mechanical properties and a protective surface oxide scale. In various embodiments, the process may include (comprise) two distinct steps. First, a layer of wüstite (FeO) is formed in a high temperature treatment stage, which for some steels may be in the vicinity of 860° C. The high temperature is selected, based on the metal being treated, to promote the formation of austenite in the interior of the workpiece while mediating the formation of wüstite in the surface scale. Control of the temperature, oxidation environment and the time of exposure may be used to adjust the wüstite scale thickness. Rapid cooling follows the high temperature treatment so as to preserve the wüstite scale, largely preventing its decomposition to magnetite or hematite, and to obtain at the same time an internal steel microstructure comprising martensite or bainite (which is amenable to subsequent tempering).

The second step of the heat treatment is carried out at a lower temperature, below the austenite formation temperature, which may be in the range of about 400° C.–610° C. The rate and duration of heating, temperature and oxidation environment are controlled to obtain an iron oxide scale comprising an intermediate layer composed substantially of wüstite (FeO, for example in various embodiments more than 90%, more than 95% or more than 99%), with a surface of substantially magnetite ($Fe_3O_4$, for example in various embodiments more than 90%, more than 95% or more than 99%), while modifying mechanical properties as desired, such as increasing the ductility and toughness (impact energy, fracture toughness) of the metal workpiece. In some embodiments, the process may be carried out so that the wüstite to magnetite ratio in the scale is in the range of about 0.5 to about 3, based on the ratio of the intensities (peak heights) of the x-ray diffraction peaks from the (311) reflection of magnetite and (200) reflection of wüstite where the monochromatic radiation used is cobalt Kα having a wavelength λ=1.789Å. In preferred embodiments, the resultant oxide scale may provide resistance to corrosion, erosion and corrosion fatigue.

In some embodiments, the oxide scale of the invention may be designed to have a desired thickness, such as about 10 μm to about 50 μm, 25 μm to about 30 μm or 45 μm to about 50 μm.

In various embodiments, the processes of the invention may be applied to the heat treatment of products made from iron-based alloys. For example, the processes of the invention may be used to enhance the protection of the interior surface of sealable vessels such as CNG pressure vessels, such as vessels used on natural gas vehicles. The processes of the invention may be used to impart an oxide scale on the interior of the cylinder which acts as a protective coating against corrosion fatigue degradation of the vessel in NGV service. CNG vessels of hardened, tempered steel having an oxide scale comprising a substrate that is substantially wüstite and a surface layer that is substantially magnetite are provided as alternative aspects of the invention.

In one aspect, the two fundamental steps of the invention discussed above may be broken down into five steps:

a. providing a first oxygen supply, accessible to the material;

b. heating the material to a first temperature for a first period of time in the presence of the first oxygen supply, wherein the first temperature, first period of time and first oxygen supply are together controlled so as to form austenite in the material and to form an external iron oxide scale comprised substantially of wüstite on a metallic substrate;

c. cooling the material sufficiently rapidly to form martensite or bainite in the material and to substantially prevent the wüstite in the scale from decomposing (into another form such as iron or magnetite);

d. providing a second oxygen supply to the material;

e. re-heating the material to a second temperature, lower than the first temperature, for a second period of time in the presence of the second oxygen supply, wherein the second temperature, second period of time and the second oxygen supply are together controlled so as to alter a mechanical property (such as hardness, strength or ductility) of the material without forming austenite, and so as to transform a surface of the scale substantially to magnetite, to form a magnetite surface, while leaving an intermediate layer composed substantially of wüstite between the metallic substrate and the magnetite surface.

DETAILED DESCRIPTION OF THE INVENTION

Figure 1:
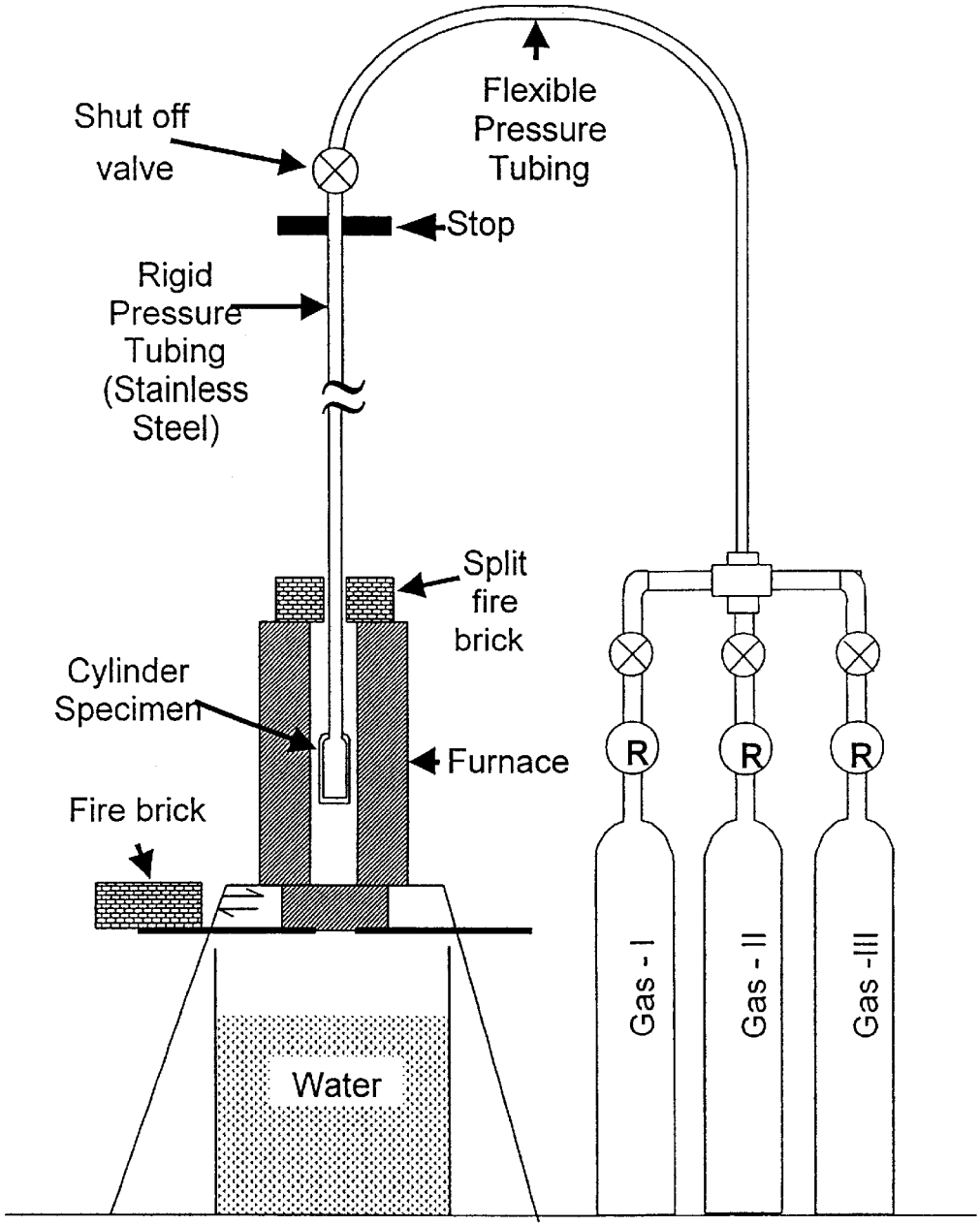
FIG. 1: Schematic set-up for the heat-treatment of the cylinder specimen.

In one aspect, the invention provides processes for the heat treatment of iron-based alloys, including irons and steels. In one aspect, the invention involves a single process for providing: (a) a metallic microstructure that provides desired mechanical properties, and (b) a protective oxide surface scale comprised primarily of a magnetite surface layer and an intermediate layer of wüstite on a metallic substrate. The invention may be practiced on a wide range of iron-based alloys in which the desired microstructure and oxide layer are produced by the processes of the invention. However, the invention may in some circumstance not be applicable to alloys that include a substantial amount of other elements such as chromium, nickel or copper, when those elements would prevent the formation of the desired oxide layers of the invention.

In some embodiments, the process of the invention produces a protective oxide scale on carbon and low-alloy steel surfaces. The definitions of carbon and lowalloy steels as referred to herein are as set out in the "Metals Handbook", Volume 1—Tenth Edition—Properties and Selection: Irons, Steels and High-Performance Alloys (Published by ASM International, 1990). In accordance with the Handbook definition, and with the American Iron and Steel Institute definition, steel is considered to be carbon steel when no minimum content is specified or required for chromium, cobalt, columbium (niobium), molybdenum, nickel, titanium, tungsten, vanadium or zirconium, or any other element to be added to obtain a desired alloying effect; when the specified minimum for copper does not exceed 0.40 per cent; or when the maximum content specified for any of the following elements does not exceed the percentages noted: manganese 1.65, silicon 0.60, copper 0.60. Low-alloy steels are a category of ferrous materials that exhibit mechanical properties different from plain carbon steels as the result of additions of alloying elements such as nickel, chromium and molybdenum. Total alloy content can range from 2.07% up to levels just below that of stainless steels, which contain a minimum of 10% Cr.

In some embodiments, the process of the invention may comprise (includes, but is not limited to) two steps: Step 1: A high temperature treatment and rapid cooling; Step 2: A lower temperature treatment. Alternatively, if a material is provided that has the characteristics of the material produced by step 1, the invention may include carrying out the process of step 2 on that starting material.

In step 1 (high temperature treatment and rapid cooling), the process is adapted to obtain an iron oxide scale of a specific type and to develop a selected microstructure, both of which are amenable to further processing in step 2. In step 1, a desired thickness of a scale made up primarily of wüstite is obtained through a controlled oxidation process at an elevated temperature, at or above the temperature at which austenite forms in the metal. In some embodiments, the elevated temperature may be in the range of 570° C. to 1200° C., or in the vicinity of 860° C. The duration of heating may for example vary in some embodiments from about 5 to about 150 minutes. The time of exposure, temperature and the nature of the oxidation medium are controlled to obtain the desired microstructure and scale. A variety of procedures may be used to generate and control the oxidation environment during heat treatment. For example, the oxidizing environment may be kept under a pressure different from atmospheric pressure, such as a gas like carbon dioxide or air at higher-than-atmospheric pressure, during this high temperature treatment. To retain the wüstite formed at the elevated temperature and to obtain a steel microstructure amenable to a subsequent tempering treatment, the sample is preferably cooled rapidly using techniques such as quenching, although other techniques to achieve this end may be used, such as a blast of a heat-conductive gas.

In step 2 (lower temperature treatment), the process is adapted to obtain desired mechanical properties of steel through tempering and to convert simultaneously the wüstite (FeO) scale into one containing a desired proportion of w üstite and magnetite ($Fe_3O_4$), with or without an amount (which may be relatively small) of hematite ($Fe_2O_3$). The conversion of wüstite (FeO) into the desired mixture of w üstite (FeO) and magnetite ($Fe_3O_4$) is carried out by controlling process parameters such as exposure time, temperature and the oxidation environment. In some embodiments, a temperature range of 300° C. to 700° C. may be used, or 400° C. to 650° C., or about 550° C. The duration of heating may for example vary in some embodiments from about 5 to about 150 minutes. Various procedures may be followed for controlling the oxygen environment during this follow-up heat treatment. In one embodiment, for example, a steel pressure vessel previously treated in accordance with step 1 to provide a starting wüstite (FeO) thickness in the range of 25–50 $\mu$m, may be sealed with atmospheric air at room temperature. The sealed vessel may be heated, for example to about 550° C. for approximately 2 hours, to produce a desired scale comprising a metallic substrate, an intermediate layer composed primarily of wüstite (FeO) and surface layer comprised primarily of magnetite ($Fe_3O_4$). In some embodiments of the invention, scale coatings may be obtained having a ratio of magnetite ($Fe_3O_4$) to wüstite (FeO) in the range of about 0.5 to about 3. It will be appreciated by those skilled in this art that the wüstite and magnetite layers in the scale will not be discrete, but form an intercalated mixture of crystalline forms that may also include other minor constituents.

The process of the present invention encompasses a wide range of means for the control of the oxygen environment during heat treatment, including among other modes a flowing gas environment and a sealed and pressurized environment. Oxygen may be provided for the process in a variety of chemical forms, such as $CO_2$, $O_2$, air, water, calcium carbonate (or other compounds that will decompose at high temperature to produce an oxygen donating agent). Various sources of oxygen may be assessed empirically for their performance in providing a desired oxide scale using standard testing methods, only some of which are specifically recited herein.

In alternative embodiments, coatings of the present invention may offer resistance against corrosion, erosion, abrasion and/or protection against corrosive environments in the presence of static or dynamic loading (for example by ameliorating corrosion fatigue). The invention may be adapted by those skilled in this art on the basis of the mechanical and chemical properties required of the finished article. Standard testing methods may be used to assess the results of varying parameters in the process of the invention, such as the temperature of heating, the duration of heating, the rates of heating and cooling and the medium used for heating and cooling.

EXAMPLE

Hollow cylinders having 51 mm (2 in.) outer diameter, 4 mm (0.165 in.) wall thickness and made of AISI/SAE-4130 steel were used. An electric resistance furnace was used for the heat treatment of the 100 mm (4 in.) long cylindrical specimen, which was welded at both ends for maintaining gas pressure inside the cylinder during the heat treatment. Quenching was carried out while the specimen remained under gas pressure. The set-up for the high temperature treatment is shown schematically in FIG. 1.

Figure 2:
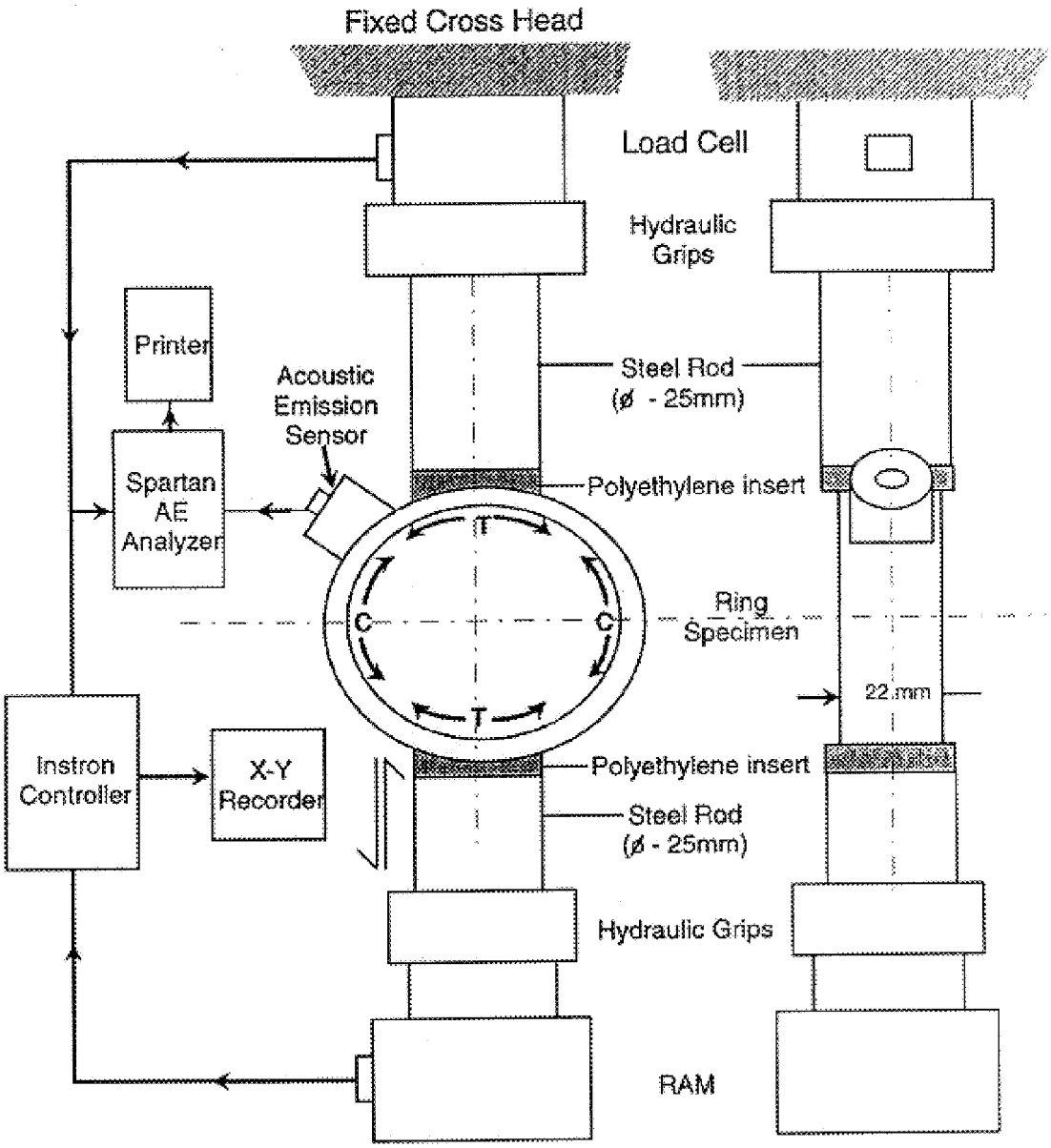
FIG. 2: Schematic set-up for the ring compression test with acoustic emission monitoring for the structural integrity evaluation of the oxide scale. Note that the oxide scale is located on the inner surface of the ring.

The oxide scale formed on the interior surface was evaluated using the following techniques. The surface morphology was examined using Scanning Electron Microscopy (SEM). Microconstituents of the scale were identified and quantified using x-ray diffraction. Cobalt K$\alpha$ monochromatic radiation ($\lambda$=1.789 Å) was used. Nondestructive characterization of the oxide scale was made using eddy current testing. Coating thickness measurements were made using metallographic sectioning and optical microscopy. Etching with Picral (5% Picric acid in ethanol) was used to examine the steel/oxide interface in detail. Structural integrity evaluation of the coating was conducted using mechanical testing and acoustic emission monitoring. FIG. 2 is a schematic set-up of the mechanical test used on ring specimens. A single acoustic emission sensor was used to detect cracking and debonding of the oxide upon mechanical straining.

Some of the lower temperature heat treatments were carried out using the same apparatus as shown in FIG. 1. Other tempering treatments were carried out on coupons cut from the cylinder and kept inside a quartz tube, which was inserted horizontally into a muffle furnace.

The results of the exemplified treatment may be broadly divided into two parts: (1) Formation of wüstite (FeO) during the high temperature treatment; and, (2) Conversion of wüstite (FeO) into magnetite ($Fe_3O_4$) or hematite ($Fe_2O_3$) during the lower temperature tempering treatment.

Figure 3:
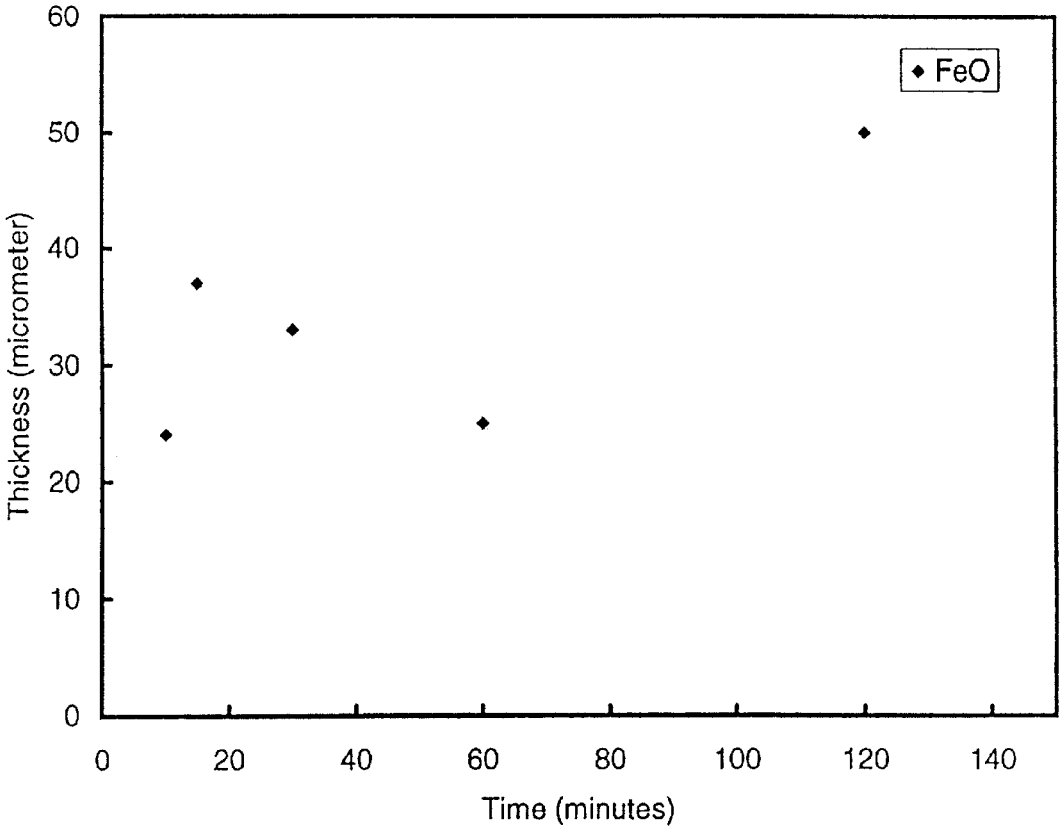
FIG. 3: Time dependence (at 860° C.) of the wüstite (FeO) scale thickness. The sealed oxidation environment was carbon dioxide under a pressure of 345 kPa (50 psig).
Figure 4:
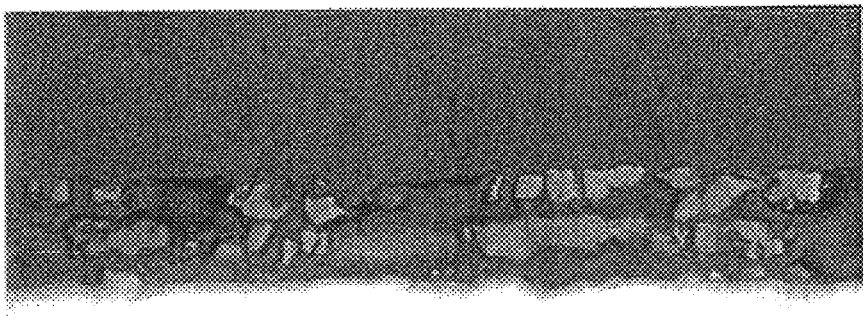
FIG. 4: Polished cross-sections of cylinder specimens treated at 860° C. and quenched: a) 15 minutes under 345 kPa (50 psig) carbon dioxide; b) 60 minutes under 414 kPa (60 psig) air. Electroless nickel was deposited on this specimen prior to specimen preparation.
Figure 4:
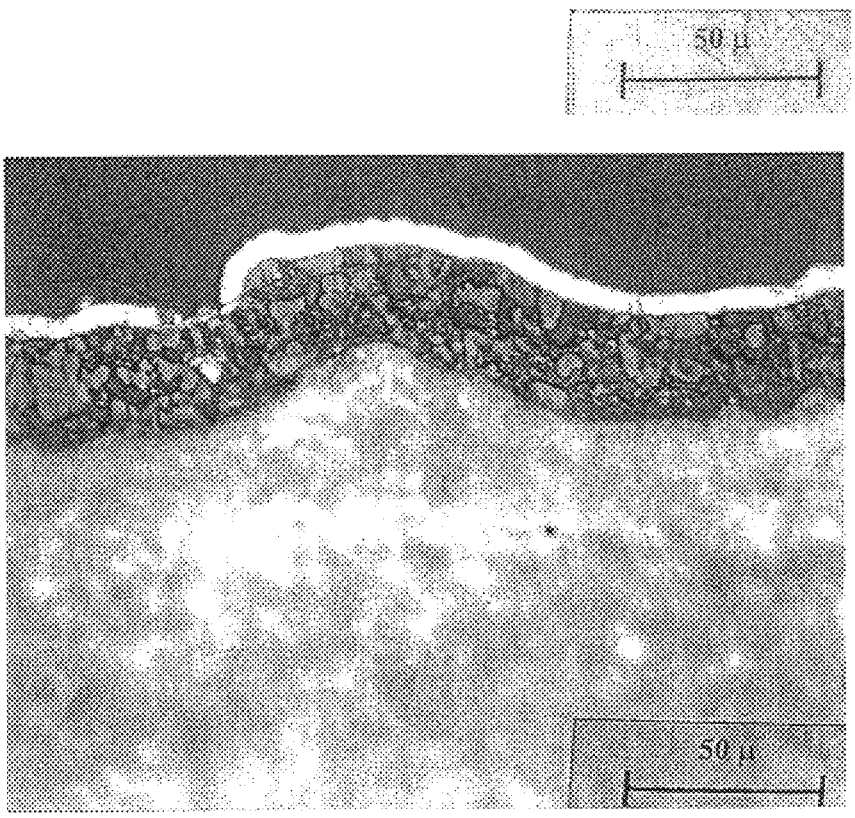
Figure 5:
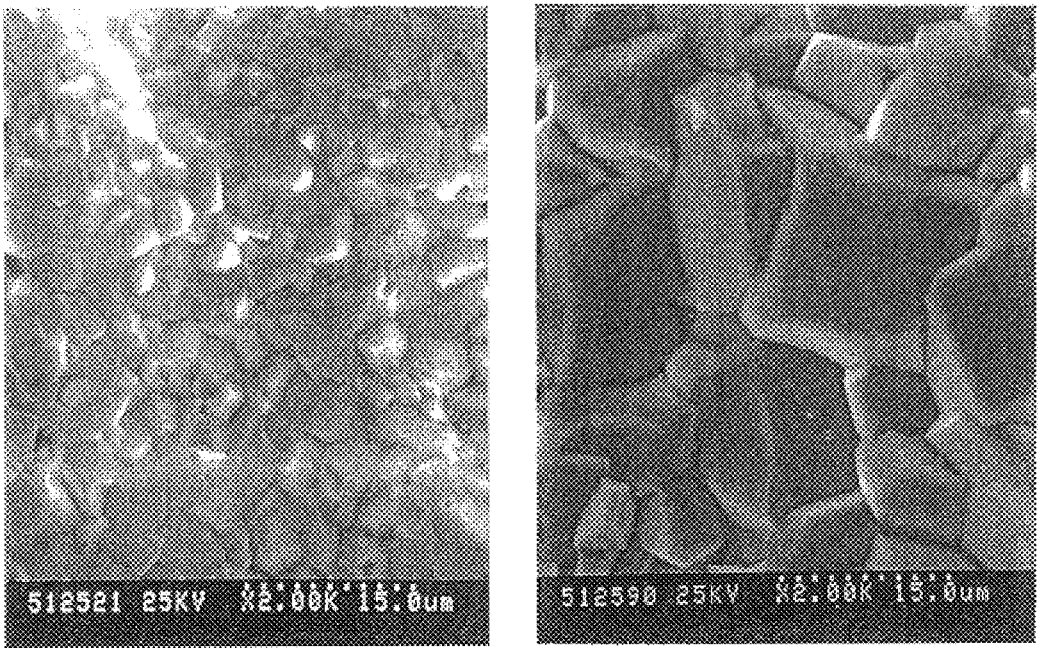
FIG. 5: Scanning electron micrographs (SEM) showing the morphology of the wüstite scale on the metallic substrate of the treated material after exposure to 860° C. under 345 kPa (50 psig) carbon dioxide and quenching: a) 10 minutes; b) 120 minutes.
Figure 6:
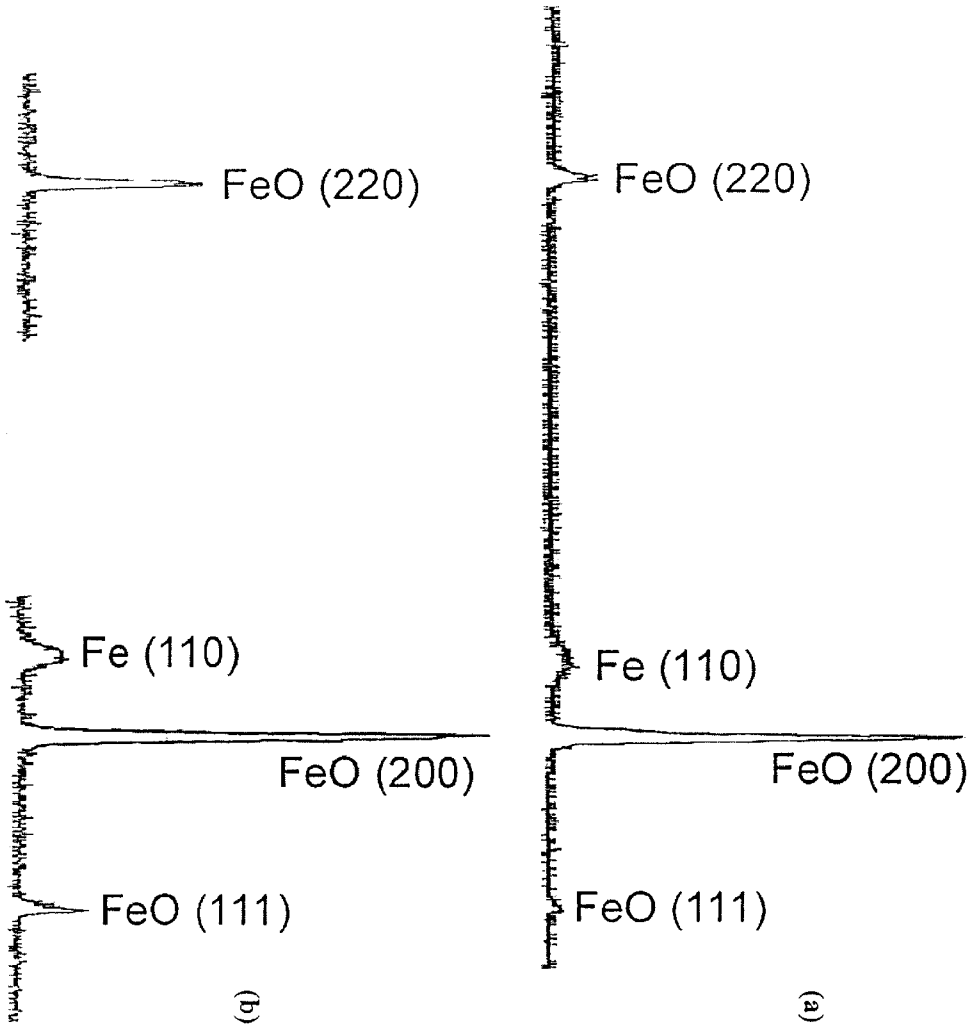
FIG. 6: X-ray diffraction patterns from the interior surfaces of cylinder specimens treated at 860° C. under 345 kPa (50 psig) carbon dioxide and quenched: a) 15 minutes; b) 120 minutes. Monochromatic cobalt K$\alpha$ radiation was used having a wavelength $\lambda$=1789 Å.

In the first step (formation of wüstite (FeO) at high temperature (around 860° C.), it was found that relatively pure wüstite (FeO), ranging in thickness up to 50 $\mu$m, may be obtained on the inner surface of the cylinder through exposure to 860° C. for periods of equal to or less than two hours if the composition and pressure of the gas inside the cylinder are controlled. Pressurization of the cylinder to 345 kPa (50 psig) carbon dioxide at room temperature followed by the exposure of the pressurized cylinder to 860° C. for 2 hours gave a 50 $\mu$m thick wüstite (FeO) coating. Treatment of the cylinder with the same pressure, temperature and time but using air produced a coating which was somewhat thinner (25–30 $\mu$m). FIG. 3 shows the time dependence of the wüstite coating thickness obtained through 860° C. exposure under a carbon dioxide pressure of 345 kPa (50 psig). FIG. 4*a* is a polished section of the cylinder showing an approximately 25 mm thick coating obtained through a 15 minute exposure to 860° C. under a carbon dioxide pressure of 345 kPa (50 psig). FIG. 4*b* shows a wüstite (FeO) scale of comparable thickness obtained with air through a longer exposure (60 minutes) at 860° C. under a higher pressure of 414 kPa (60 psig). The lighter coating on top of the oxide is a layer of electroless nickel which was deposited on the oxide prior to the sectioning of this cylinder. FIG. 5 shows two scanning electron micrographs of the wüstite surfaces obtained through 10 minutes and 120 minutes exposure respectively to 860° C. under a carbon dioxide pressure of 345 kPa (50 psig). The wüstite grains become coarser the longer the exposure time at 860° C. X-ray diffraction patterns obtained from the interior surface of the cylinder following exposure to 860° C. for 15 minutes and 120 minutes under a carbon dioxide pressure of 345 kPa (50 psig) are shown in FIG. 6. The texture of the coating changes as it becomes thicker.

In the second step of the exemplified process (comprising lower temperature treatment at 400–610° C.), gradual conversion of wüstite (FeO) into magnetite ($Fe_3O_4$) occurs over time. For a given time, the amount of magnetite ($Fe_3O_4$)

formed in relation to the residual wüstite (FeO) depends on the exposure temperature and the environment. particularly oxygen availability, inside the cylinder. At longer exposure times, a gradual conversion of magnetite ($Fe_3O_4$) into hematite ($Fe_2O_3$) may occur. In the exemplified embodiment, only small quantities of $Fe_2O_3$ were formed in treatments carried out for up to 2 hours at a temperature in the range of 400–610° C. The amount of $Fe_2O_3$ formed in the 1–2 hour treatments increased with increases in the tempering temperature. For example, following a treatment at 400° C. there was no detectable $Fe_2O_3$.

Figure 7:
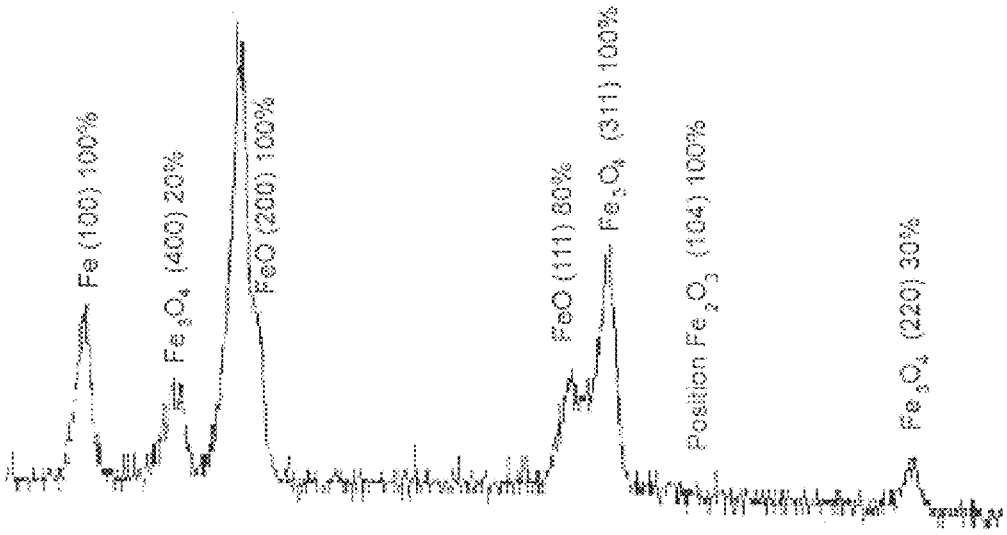
FIG. 7: X-ray diffraction pattern from the interior surface of a cylinder specimen treated at 860° C. for two hours, quenched, purged with air, re-sealed and exposed to 550° C. for one hour. Monochromatic cobalt K$\alpha$ radiation was used having a wavelength $\lambda$=1.789 Å.

FIG. 7 is an x-ray diffraction pattern of the interior surface of a cylinder following quenching from a first temperature of 860° C. and a subsequent 1 hour treatment at a second temperature of 550° C. This cylinder was filled with $CO_2$ to 345 kPa (50 psig) at room temperature, heated to 860° C. and maintained at temperature for 2 hours. Following quenching, the cylinder was vented to remove spent gases, refilled with air under atmospheric pressure, sealed, heated to 550° C. and maintained for 1 hour.

Figure 8:
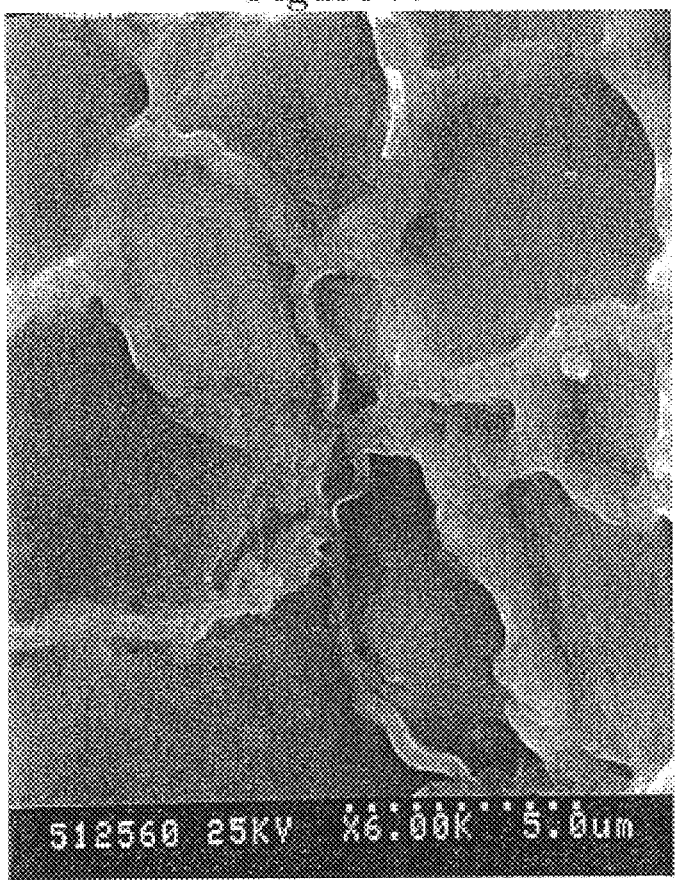
FIG. 8: Scanning electron micrograph showing the morphology of the scale following the treatment of the specimen as described for FIG. 7.

FIG. 8 is a scanning electron micrograph of the specimen surface, the x-ray diffraction pattern for which is shown in FIG. 7. The wüstite (FeO) grains are covered with magnetite ($Fe_3O_4$).

Figure 9:
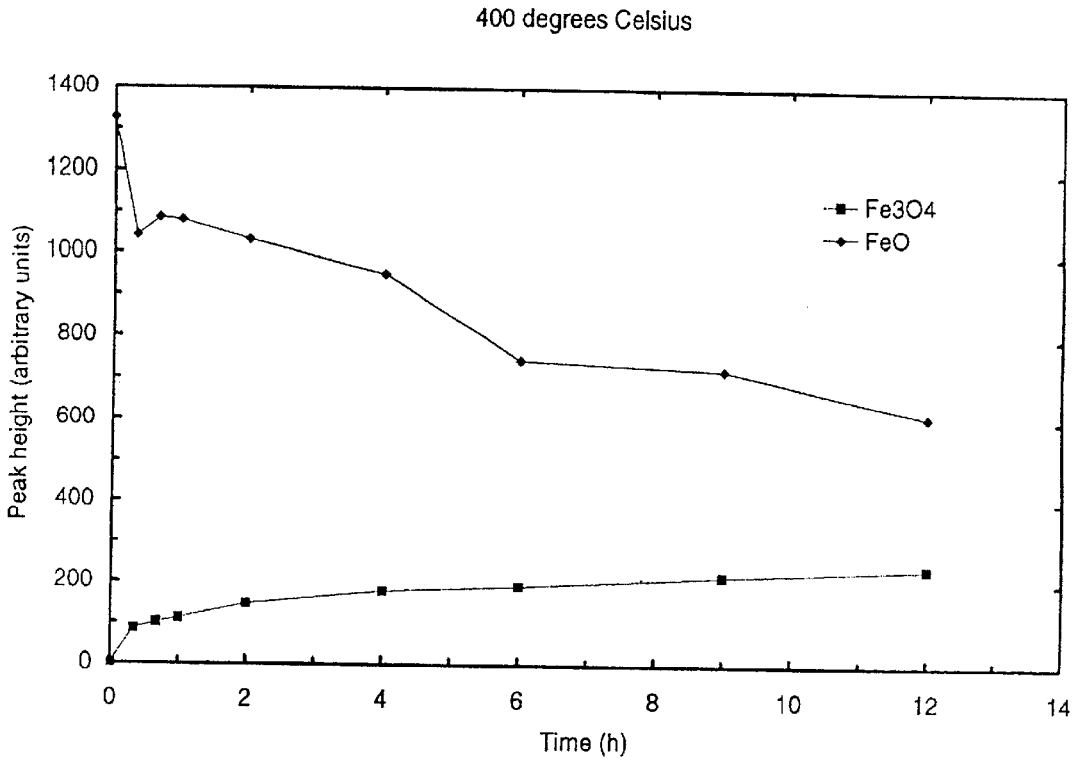
FIG. 9: Time dependence of the intensities of selected x-ray, diffraction peaks from iron oxides. The initial oxide was FeO with a thickness of 25 $\mu$m prior to exposure at 400° C.
Figure 10:
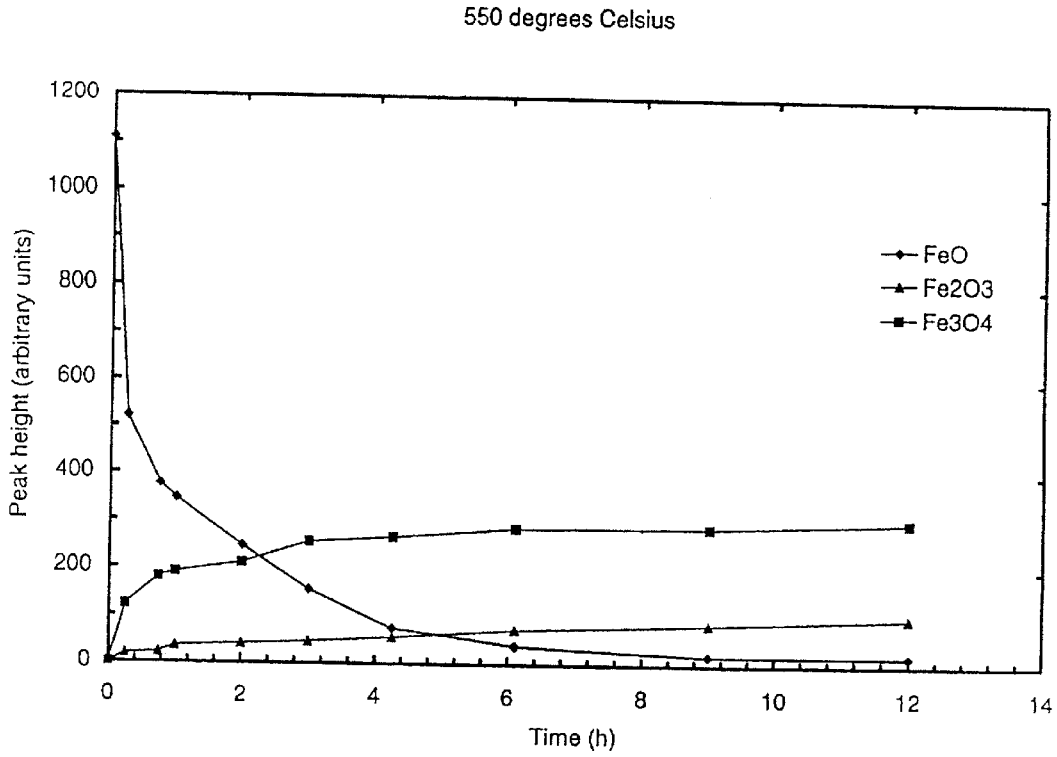
FIG. 10: Time dependence of the intensities of selected x-ray diffraction peaks from iron oxides at 400° C. The initial oxide was FeO with 25 $\mu$m in thickness prior to exposure at 550° C.
Figure 11:
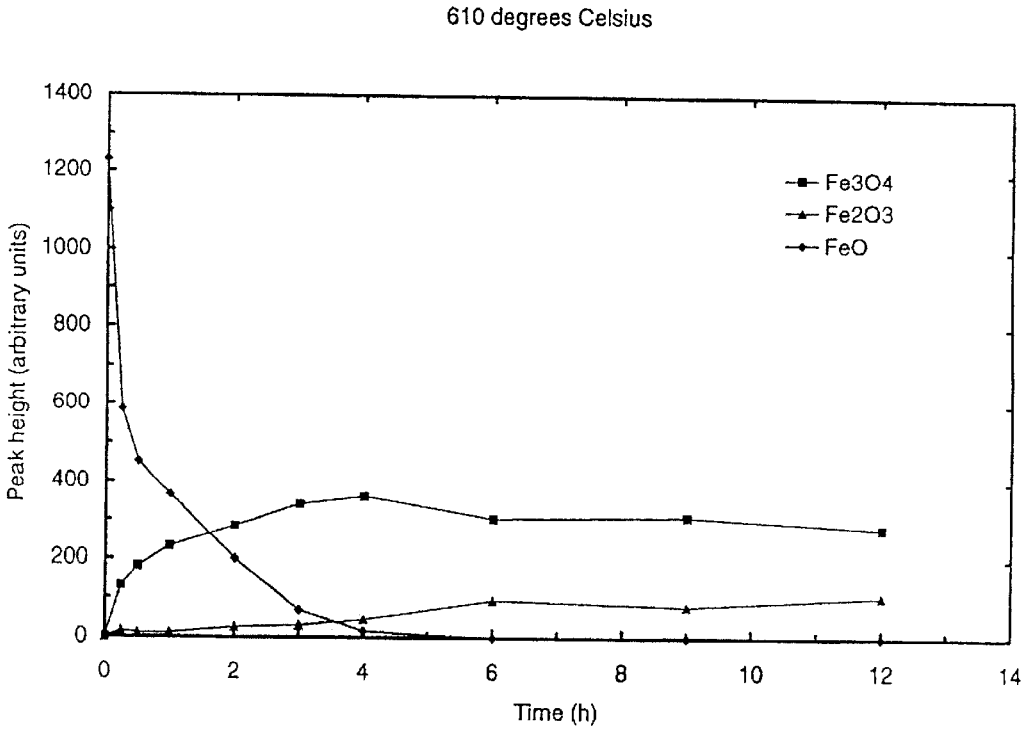
FIG. 11: Time dependence of the intensities of selected x-ray diffraction peaks from iron oxides at 400° C. The initial oxide was FeO with 25 $\mu$m in thickness prior to exposure at 610° C.

FIGS. 9, 10 and 11 show the change in the intensities of various peaks from FeO, $Fe_3O_4$ and $Fe_2O_3$ in the x-ray diffraction patterns of specimens treated in closed atmospheric air environment at temperatures of 400, 550 and 610° C. respectively. These tempering treatments were carried out on a starting wüstite (FeO) coating which was 25–30 $\mu$m thick. Similar processes have been carried out with other intermediate temperatures using 25–30 $\mu$m FeO coatings. Data on coatings in the thickness range of 10–50 $\mu$m have been generated using the tempering temperature range of 400–610° C.

The structural integrity of the iron oxide coatings (scale) produced by the processes of the invention may be assessed in a variety of ways, and such tests may be used to tailor the processes of the invention for particular applications. For example, in particular embodiments, compression tests on rings cut from treated cylinders, along with acoustic monitoring (FIG. 2), showed that if the ratio of $Fe_3O_4$:FeO is maintained within a certain range, the oxide coating did not debond or crack until significant plastic deformation occurs to the steel substrate. However, similar results need not necessarily be desired, or achieved, in all embodiments of the invention.

Figure 12:
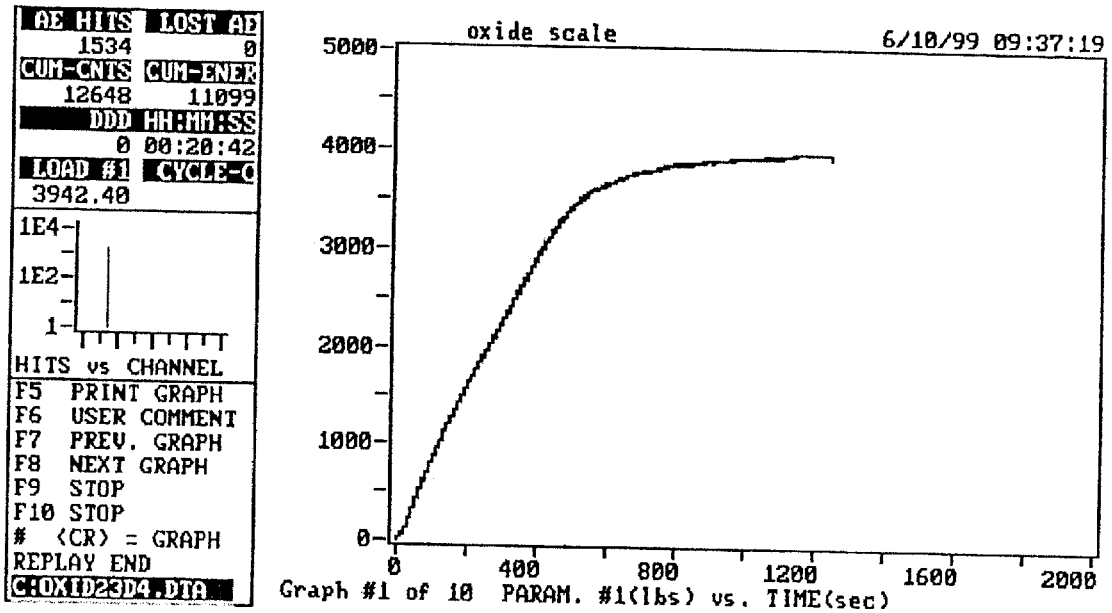
FIG. 12: Compressive load on the ring vs. time and acoustic events (hits) vs. time plots for a cylinder treated for 2 hours at 850° C. under 345 kPa (50 psig) carbon-dioxide, introduced at ambient temperature. The cylinder was quenched, purged with air, re-sealed and exposed to 2 hours at 550° C. The coating was 25–30 $\mu$m thick.
Figure 12:
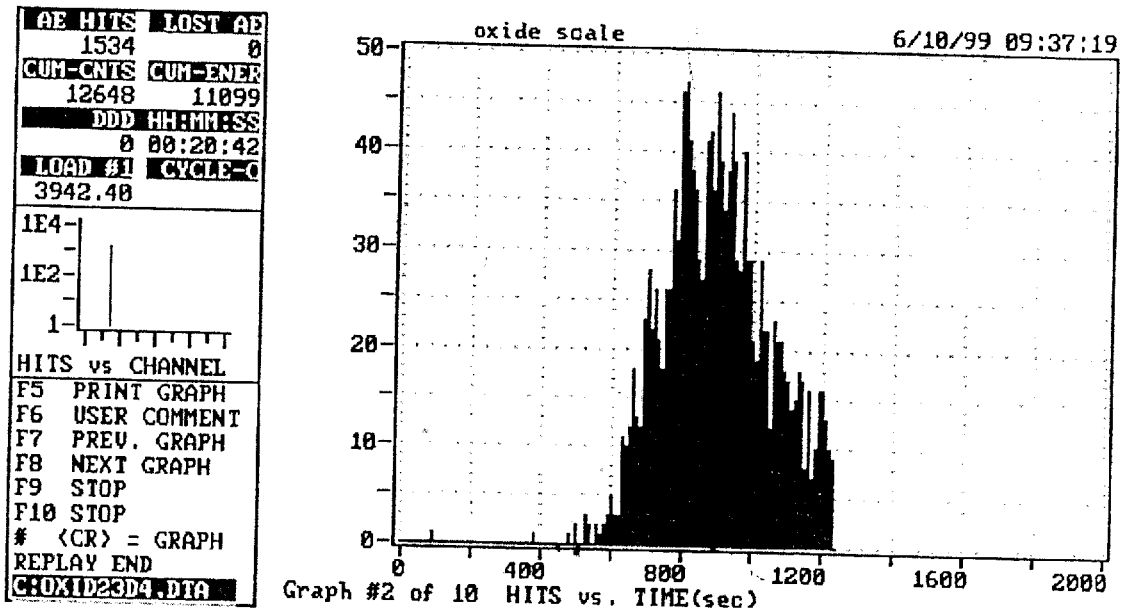

FIG. 12 shows a plot of compressive load on a ring cut from treated cylinders, versus time, along with the plot of the number of acoustic events from the specimen (hits) versus time. That ring originally had a 25–30 $\mu$m thick FeO coating which was converted into approximately equal proportions of FeO and $Fe_3O_4$ through a 2 hour treatment at 550° C. in a closed air environment. For comparison, relatively pure w üstite or $Fe_3O_4$ coatings were subjected to mechanical testing and simultaneous acoustic emission monitoring. The wüstite coatings did not crack until significant plastic deformation had occurred to the steel substrate. However, a relatively pure wüstite (FeO) scale was found to be not as resistant to abrasion. In tests, wüstite scale could be damaged more readily than scales produced in accordance with the invention. In similar tests, a relatively pure $Fe_3O_4$ scale was found to be highly resistant to abrasion. However, the relatively pure $Fe_3O_4$ scale was found to be brittle. For example, when the proportion of $Fe_3O_4$ was high compared with FeO, the scale cracked at lower loads. It is not however a necessary feature of the processes of the invention that they will always produce an oxide scale that is more abrasion resistant than a relatively pure wüstite scale, or less brittle than a relatively pure $Fe_3O_4$ scale.

In one preferred embodiment, therefore, the invention provides an iron oxide scale on a metallic substrate, where the scale comprises an intermediate layer composed predominantly of FeO with a surface layer composed primarily of $Fe_3O_4$. Such scales may in certain embodiments provide protective coatings that may be tailored to withstand dynamic stresses and abrasion in service. The magnetite-rich surface of such scales may also be resistant to corrosion.

What is claimed is:

1. A process for treating an iron-based alloy material comprising:

a) providing a first oxygen supply to the material;

b) heating the material to a first temperature for a first period of time in the presence of the first oxygen supply, wherein the first temperature, first period of time and first oxygen supply are together controlled so as to form austenite in the material and to form an external iron oxide scale comprised substantially of w üstite on a metallic substrate;

c) cooling the material sufficiently rapidly to form martensite or bainite in the material and to substantially prevent the wüstite in the scale from decomposing;

d) providing a second oxygen supply to the material;

e) re-heating the material to a second temperature, lower than the first temperature, for a second period of time in the presence of the second oxygen supply, wherein the second temperature, second period of time and the second oxygen supply are together controlled so as to alter a mechanical property of the material without forming austenite, and so as to transform a surface of the scale substantially to magnetite, to form a magnetite surface, while leaving an intermediate layer composed substantially of wüstite between the metallic substrate and the magnetite surface.

2. The process of claim 1, wherein the final ratio of w üstite to magnetite in the scale is in the range of 0.5 to 3.

3. The process of claim 1 wherein the material is selected from the group consisting of carbon steels and low-alloy steels.

4. The process of claim 1 wherein the first temperature is in the range of 570° C. to 1200° C.

5. The process of claim 4 wherein the first temperature is about 860° C.

6. The process of claim 1 wherein the second temperature is in the range of 300° C. to 700° C.

7. The process of claim 6 wherein the second temperature is in the range of about 400° C. to about 650° C.

8. The process of claim 7 wherein the second temperature is about 550° C.

9. The process of claim 1 wherein the scale further comprises hematite.

10. The process of claim 1 wherein the scale has a thickness in the range of about 10 $\mu$m to about 50 $\mu$m.

11. The process of claim 10 wherein the scale has a thickness in the range of about 25 $\mu$m to about 30 $\mu$m.

12. The process of claim 11 wherein the scale has a thickness in the range of about 45 $\mu$m to about 50 $\mu$m.

13. The process of claim 1 wherein the first oxygen supply comprises a fixed amount of an oxygen-containing gas at a higher-than-atmospheric pressure.

14. The process of claim 13, wherein the gas is selected from the group consisting of carbon dioxide and air.

15. The process of claim 14, wherein the gas comprises carbon dioxide and the higher-than-atmospheric pressure is about 345 kPa at room temperature.

16. The process of claim 14, wherein the gas comprises air and the higher-than-atmospheric pressure is about 414 kPa at room temperature.

17. The process of claim 1 wherein the second oxygen supply comprises a fixed amount of air at atmospheric pressure.

18. The process of any one of claims 1 through 17, wherein the first period of time is in the range of from about 5 minutes to about 150 minutes.

19. The process of claim 1 wherein the second period of time is in the range of from about 5 minutes to 150 minutes.

20. A process for treating an iron-based alloy material comprising:

a) providing an iron-based alloy material comprising a metallic substrate comprising martensite or bainite and an external iron oxide scale composed substantially of wüstite on the metallic substrate;

b) providing an oxygen supply to the material;

c) heating the material to a temperature for a period of time in the presence of the oxygen supply, wherein the temperature, period of time and the oxygen supply are together controlled so as to alter a mechanical property of the material without forming austenite, and so as to transform a surface of the scale substantially to magnetite to form a magnetite surface, while leaving an intermediate layer composed substantially of wüstite between the metallic substrate and the magnetite surface.

* * * * *